United States Patent [19]

Linda

[11] 4,376,320

[45] Mar. 15, 1983

[54] VACUUM CLEANER HEAD FOR SUBMERGED SURFACES

[75] Inventor: Fabio B. V. Linda, Transvaal, South Africa

[73] Assignee: Poolquip Industries (Proprietary Limited), Johannesburg, South Africa

[21] Appl. No.: 320,843

[22] Filed: Nov. 12, 1981

[30] Foreign Application Priority Data

Nov. 18, 1980 [ZA] South Africa ..... 80/7154

[51] Int. Cl.[3] ..... F04H 3/20

[52] U.S. Cl. ..... 15/1.7

[58] Field of Search ..... 15/1.7, 415

[56] References Cited

U.S. PATENT DOCUMENTS 3,273,188 9/1966 Levack ..... 15/1.7

3,509,589 5/1970 Bond ..... 15/1.7

*Primary Examiner*—Edward L. Roberts

*Attorney, Agent, or Firm*—Morgan, Finnegan, Pine, Foley & Lee

[57] ABSTRACT

A vacuum cleaner head for use on submerged surface, such as in swimming pools, has a flat body to which wheels are attached. The wheels are mounted on axles in fittings which are subsequently mounted on the flat body. Flanges on the flat body cooperate with the fittings to prevent the axles or the wheels from becoming detached.

5 Claims, 1 Drawing Figure

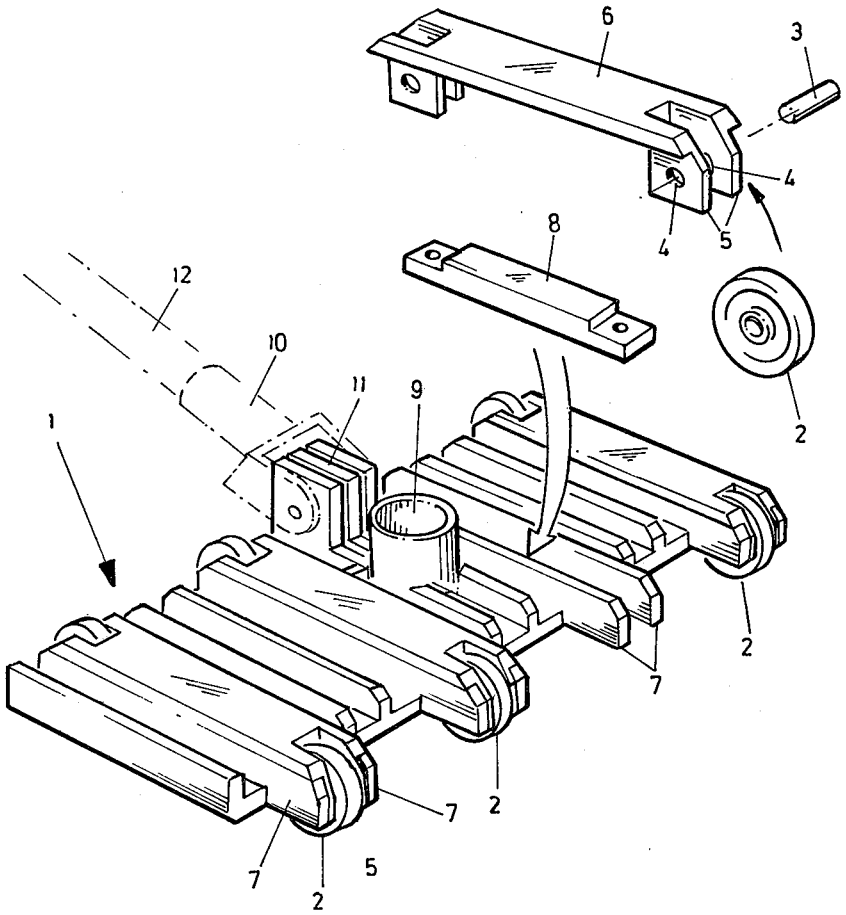
6
3
4
4
5
8
12
10
11
9
1
2
2
7
7
2
7
2
5

VACUUM CLEANER HEAD FOR SUBMERGED SURFACES

FIELD OF THE INVENTION

This invention relates to a vacuum cleaner head for the cleaning of submerged surfaces and, in particular but not exclusively, for the purpose of cleaning swimming pool surfaces by moving such a vacuum cleaner head over the surfaces by means of a suitable pole which is usually releasably attached to the vacuum cleaner head.

BACKGROUND OF THE INVENTION

A type of vacuum cleaner head is known which is simply a substantially planar member with at least four and often eight or more wheels for supporting the planar member above a pool surface. In this type of vacuum cleaner head the wheels are usually secured between projecting spaced flanges on a brass bolt and nut assembly with the bolt, which forms a wheel axle, passing axially through the wheel and through the projecting flanges.

The disadvantage of the latter type of construction is that the nuts and bolts can work loose, and a wheel and the nut and bolt themselves may be lost or have to be retrieved from the bottom of a swimming pool. Furthermore, the nuts and bolts are usually made of solid brass to avoid corrosion thereof and solid brass articles are extremely costly.

SUMMARY OF THE INVENTION

According to the invention, there is provided a vacuum cleaner head for use on submerged surfaces, the head comprising a generally planar body, an opening through the body to which a vacuum source can be connected, and a plurality of wheels for supporting the body above a submerged surface, the wheels being mounted on axles which pass through holes in fittings mounted on the body, the wheel axles being secured in place in the holes when the fittings are mounted on the body between flanges on the body.

Further features of the invention provide for the fittings to be releasably secured to the body e.g. by way of fasteners passing through the body and into the fittings; for the said fasteners to be employed for securing lead or other weights to the body to ensure that the body can easily be maintained in contact with a submerged surface during use; and for the fittings, wheels, axles and body to be made from injection moulded plastics material.

In use, a relatively narrow layer of water is sandwiched between the body and the surface being cleaned and water drawn by the vacuum source through the opening in the body moves dirt on the surface towards and subsequently into the vacuum outlet. The body may also have conventional attachment means hinged thereto for connection to a manually manoeuvrable pole or the like which can be of the conventional tubular aluminium construction.

DESCRIPTION OF A PREFERRED EMBODIMENT

In order that the invention may be more fully understood one embodiment thereof will now be described, by way of example, with reference to the accompanying drawing which is a partly exploded isometric view of a vacuum cleaner head according to this invention.

The drawing shows a swimming pool vacuum cleaner head with a generally planar body member indicated by the numeral 1, made from injection moulded plastics material and of a substantially conventional shape. The head is made to have a width substantially greater than its effective length so that, in use, a broad strip of surface can be cleaned in one pass of the vacuum cleaner head thereover. The body is supported by eight wheels 2.

Each wheel 2, which is also an injection moulded plastics article, is rotatably mounted on an axle 3 supported in apertures 4 in spaced flanges 5 formed as part of injection moulded plastic fittings 6. Each fitting has flanges 5 at each end thereof and is adapted to extend along the length of the body as illustrated in the drawing. A wheel 2 is supported at each end of each fitting with the axis of rotation of the wheels being at right angles to the length of the fitting.

The flanges 5 of each fitting are adapted to fit neatly between flanges 7 formed integral with the body 1 on the upper surface thereof. The flanges 7 extend along the entire length of the body. Located between the flanges 7 in the central region thereof are lead weights 8 which are secured to the body by means of the same fasteners as are used to secure the fittings 6 thereto.

Such fasteners are conveniently screws passed from the underside of the body through the lead weights 8 and into co-operating formations or portions of the fittings 6.

It will be understood that with axles 3 located between the flanges 7 the axles cannot move axially out of the apertures 4 in the fitting. Thus, it is not possible for wheels to become dissociated from the vacuum cleaner body whilst the fittings remain in association with the body.

As is usual in this type of vacuum cleaner head a centrally located suction connection 9 is provided for attachement of a vacuum hose thereto and a connector member 10 (shown in dotted lines) is hingedly attached to formations 11 on the body of the vacuum cleaner head so that a pole, conveniently a tubular aluminum pole, can be releasably attached to this connector 10.

In use the vacuum cleaner head described above operates in the same manner as the prior art vacuum cleaner heads but with a substantially reduced risk of ever losing a wheel. Also, as a result of the fact that the parts are injection moulded from plastics material, costs are somewhat reduced.

Many variations may be made to the above described embodiment of the invention without departing from the scope of the invention as defined by the appended claims. In particular, the fittings referred to and described above could be made to support only one wheel each and the fasteners employed for securing them to the body need not serve the dual function of securing weights thereto. Also certain of the parts need not be injection moulded but could be formed in any other suitable manner. For example, the axles could be formed by an extrusion process as could the wheels. The body could be cast or vacuum formed.

I claim:

1. A vacuum cleaner head for use on submerged surfaces, the head comprising a generally planar body, an opening through the body to which a vacuum source can be connected, upstanding flanges on the body, fittings mounted on the body and located between the flanges, axle mounting holes through the fittings, axles mounted in the holes, and wheels journalled on the axles, the axles being secured in place in the holes by the flanges on either side of the fittings, and the wheels being arranged to support the body above a submerged surface.

2. A vacuum cleaner head as claimed in claim 1, including means for releasably mounting the fittings on the body.

3. A vacuum cleaner head as claimed in claim 1 including weights mounted on the body using the same mounting means as are used for mounting the fittings.

4. A vacuum cleaner head as claimed in claim 1, wherein each fitting extends over the length of the body and mounts wheels at each end of the body.

5. A vacuum cleaner head as claimed in any preceding claim, wherein the fittings, wheels, axles and body are made from injection moulded plastics material.

* * * * *